United States Patent [19]

Cooper, Jr.

[11] 4,241,975

[45] Dec. 30, 1980

[54] CAST BUS BAR CONNECTOR HAVING HOLLOW CROSS-SECTIONAL AREA

[75] Inventor: James J. Cooper, Jr., St. Louis, Mo.

[73] Assignee: International Telephone and Telegraph Corporation, New York, N.Y.

[21] Appl. No.: 22,739

[22] Filed: Mar. 22, 1979

[51] Int. Cl.[3] ..... H01R 11/01

[52] U.S. Cl. ..... 339/242; 339/272 R

[58] Field of Search ..... 339/19, 263, 272, 242

[56] References Cited

U.S. PATENT DOCUMENTS

| | | | |
|---|---|---|---|
| 3,480,905 | 11/1969 | Toedtman | 339/263 R |
| 3,585,566 | 6/1971 | Sievert | 339/19 |

FOREIGN PATENT DOCUMENTS

| | | | |
|---|---|---|---|
| 1017425 | 1/1974 | Canada | 339/242 |
| 2453004 | 5/1976 | Fed. Rep. of Germany | 339/242 |

*Primary Examiner*—John McQuade

*Attorney, Agent, or Firm*—James B. Raden; William J. Michals

[57] ABSTRACT

A hollow bus bar connector for use with cable conductors of a power distribution system. The bus bar includes a plurality of terminals extending from a common bar for mechanically engaging and electrically connecting said terminals to said bus bar connector. The bus bar is formed in a casting operation in which a plurality of cores are respectively provided in the terminal and common bar portions of the connector. The resulting casting exhibits a uniform hollow cross-sectional area in which shrinkage of and porosity in the external surfaces of the connector are substantially avoided. Accordingly, the resulting bus bar connector is lighter in weight and the external surface thereof provides for a more uniform application of insulation to the connector.

2 Claims, 3 Drawing Figures

CAST BUS BAR CONNECTOR HAVING HOLLOW CROSS-SECTIONAL AREA

BACKGROUND OF THE INVENTION

This invention relates to bus bar connectors and, more particularly, to such connectors which are utilized in power distribution systems and which include a coating of water-impervious material to provide an insulated and waterproof connection.

Bus bar connectors including an elongated bus bar having a plurality of transversely projecting terminals for attachment to the flexible conductors of a power distribution system are known and have been widely used in the art. Bus bar connectors of this type are exemplified in U.S. Pat. No. 3,480,905, which is assigned to the same assignee as the present invention. In the prior art, these bus bars all have terminals extending from a solid common bar such as a casting or a machined workpiece. These bus bar connectors are generally divided into two types depending on the terminal configuration. In the first, a flat tang accommodates a terminal lug attached to the tang by means of a threaded fastener such as a bolt. The other type includes a bore within the terminal, such as that provided by a core during the casting operation, and a set screw projecting into the bore through a second (threaded) bore extending transversely of the first bore.

These prior art devices are heavy and overdesigned in that the cross-sectional area of the bus bar is typically substantially greater than the cross-sectional area of the maximum conductor for which the bus bar connector was designed. That is, the excess material not only contributes to the weight of device but also needlessly adds expensive handling problems. Moreover, the casting operation gives rise to porosity and shrinkage problems on the external surfaces of the completed casting. That is, due to the large mass of a typical bus bar connector, shrinkage and surface porosity problems are encountered during the cooling operation of the casting process. Since these bus bar connectors are intended to be used in a sealed and insulated environment they are coated with water-impervious insulating material such as PVC. Accordingly, those completed casting exhibiting porosity and shrinkage problems are not suitable for the subsequent coating operation and hence a high reject rate in the operation of applying the insulation to the bus bar connectors has been experienced.

These and other disadvantages are overcome by the present invention wherein a bus bar connector is provided for use with cable conductors of a power distribution system wherein the bus bar is provided as a hollow device wherein the cross-sectional area of the wall portion of the connector are still at least as great as the corresponding cross-sectional area of the respective connectors but which the weight, expense, porosity and shrinkage problems are avoided.

SUMMARY OF THE INVENTION

Briefly, a bus bar connector for interconnecting the prepared cable ends of a power distribution system is provided. The connector comprises an elongated common bus bar having a plurality of terminals extending therefrom with each of the terminals including means for respectively fastening the conductor portions of the cable ends to the terminals. The bus bar is formed as a hollow casting wherein the cross-sectional area of the common bus bar and the adjacent portions of the terminals form an opening extending from the external surface of at least one of the terminals and substantially through the entire length of the common bus bar.

BRIEF DESCRIPTION OF THE DRAWING

The advantages of this invention will become more readily appreciated as the same becomes completely understood by reference to the following detailed description when taken in conjunction with the accompanying drawing wherein.

DETAILED DESCRIPTION

Figure 1:
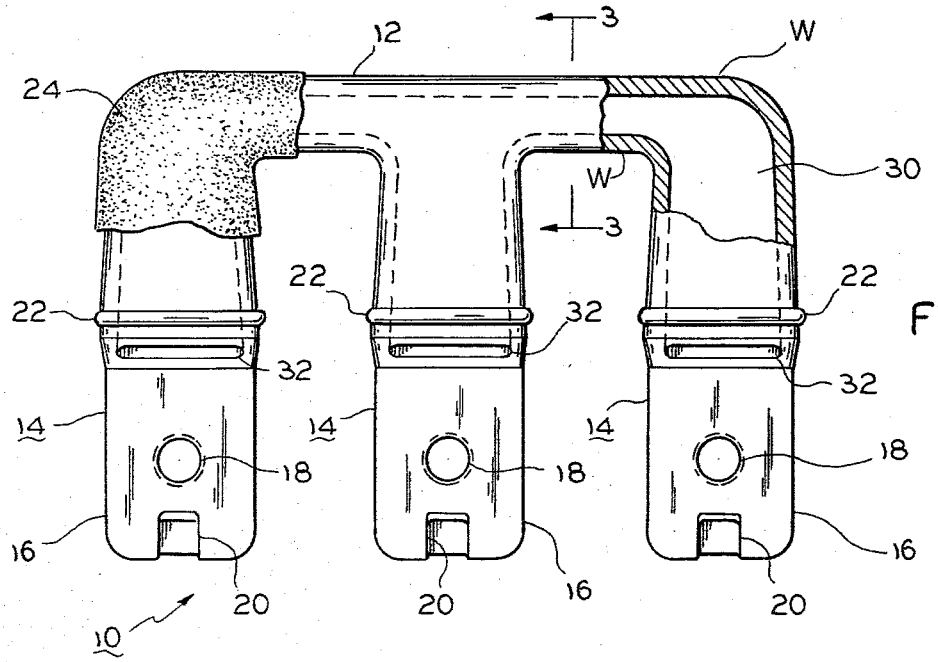
FIG. 1 is a fragmentary top view of an exemplary bus bar connector manufactured in accordance with the principles of the present invention.
Figure 2:
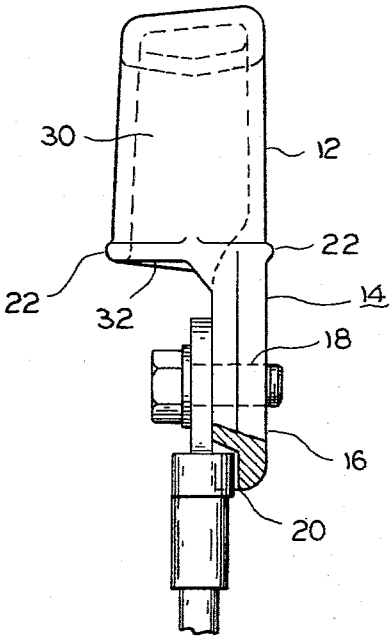
FIG. 2 is an end view of the bus bar connector of FIG. 1.

Referring now to FIG. 1 there is shown generally at 10 a bus bar connector in accordance with the principles of the present invention. Connector 10 includes a common bus bar portion 12 and a plurality of essentially identical terminals 14 depending transversely therefrom. Each terminal includes a depending tang 16 having a threaded bore hole 18 provided at a central portion therein. Each tang further includes a square notch 20 for receiving the corresponding key of a lug attachment therein for precluding relative rotation of the lug relative to tang 16, as illustrated in FIG. 2. The central portion of each terminal includes a raised ring portion 22 which cooperates with a corresponding annular groove provided in the associated insulating sleeve (not shown) once the bus bar connector is installed in its intended environment. The external surface of bus bar connector 10 is coated with a suitable water-impervious insulating material 24 such as PVC. The coating is provided along each terminal to a point which is ultimately completely enclosed by the insulating sleeve at the time of installation. However, for clarity only a portion of the coating 24 is illustrated in FIG. 1.

Figure 3:
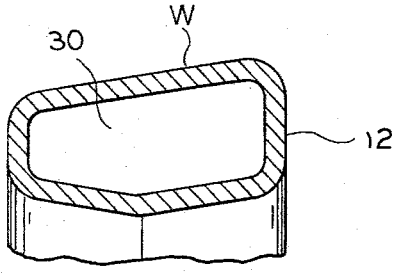
FIG. 3 is a cross-sectional view taken along the lines 3—3 of FIG. 1 and illustrating the hollow cross-sectional area of the bus bar connector in accordance with the teachings of the present invention.

Still referring to FIG. 1, it can be seen that connector 10 includes a hollow chamber 30 therein as defined by wall portions w. The cross-sectional area of connector 10, as illustrated in FIG. 3, is preferably at least equal to the area of the conductor or conductors attached to tangs 16 of terminals 14. The chamber preferably extends through the entire length of the common bus bar portion 12 and terminates at at least one opening 32 provided at the joinder of tang 16 with the body of terminal 14. The chamber 30 is formed by coring during the casting process. That is, one or more cores, such as sand impregnated with epoxy or a suitable resin, is placed in the mold cavity so that the molten metal flows around the core between it and the walls of the mold cavity. The purpose of opening 32 is to provide means for removing the frangible core material after the molten metal has solidified. Openings 32 also provide means for supporting the cores externally of the portion of the mold cavity which forms the common bus bar. It has been found that when the bus bar is constructed in accordance with the present invention, the finished article avoids the porosity and shrinkage problems of the prior art.

While the invention has been described with reference to a bus bar connector having terminals with depending tang portions for accommodating terminal lugs, it will be appreciated by those skilled in the art that the invention is equally applicable to bus bar connectors utilizing set screws in threaded bore holes of the terminals. Further, opening 32 may be provided on any suitable surface portion of the bus bar connector and need not to be limited to the terminal portions. For example, bus bar connectors are also utilized for padmount or connection to the threaded stud of a transformer bushing. In these applications, one end of the common bus bar is provided with an opening for receiving an adapter for effecting the external connection. Accordingly, the hollow bus bar in accordance with the present invention may advantageously utilize this surface opening as one end of the hollow cavity.

What has been taught, then, is a hollow bus bar connector facilitating, notably, a finished product which is free from casting shrinkage and porosity. The form of the invention illustrated and described herein is but a preferred embodiment in the form currently preferred for manufacture. It is shown as an illustration of the inventive concepts and not by way of limitation and it is pointed out that modifications and alterations may be indulged in within the scope of the appended claims.

What is claimed is:

1. A bus bar connector for interconnecting the prepared cable ends of a power distribution system comprising an elongated common bus bar having a plurality of terminals extending therefrom each of said terminals including means for respectively fastening the conductor portions of said cable ends to said terminals and wherein said bus bar connector is formed as a hollow casting and wherein wall portions of said common bus bar and the adjacent portions of said terminals form a chamber extending from an opening on the external surface of at least one of said terminals and through said common bus bar.

2. A bus bar connector for interconnecting the prepared cable eneds of a power distribution system comprising an elongated common bus bar having a plurality of terminals extending therefrom each of said terminals including means for respectively fastening the conductor portions of said cable ends to said terminals and wherein said bus bar connector is formed as a hollow casting and wherein wall portions of said common bus bar and the adjacent portions of said terminals form a chamber extending from an opening on the external surface portion of said bus bar and through said common bus bar.

* * * * *